US007696694B2

(12) United States Patent
Vossen et al.

(10) Patent No.: US 7,696,694 B2
(45) Date of Patent: Apr. 13, 2010

(54) LOW-PRESSURE MERCURY VAPOR DISCHARGE LAMP

(75) Inventors: Engelbertus Cornelius Petrus Maria Vossen, Eindhoven (NL); Cornelia Titia Staats, Eindhoven (NL); Leonie Maria Geerdinck, Eindhoven (NL); Esther De Beer, Eindhoven (NL); Ingrid Jozef Maria Snijkers-Hendrickx, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 611 days.

(21) Appl. No.: 10/522,285

(22) PCT Filed: Jul. 11, 2003

(86) PCT No.: PCT/IB03/03129

§ 371 (c)(1),
(2), (4) Date: Nov. 21, 2005

(87) PCT Pub. No.: WO2004/013892

PCT Pub. Date: Feb. 12, 2004

(65) Prior Publication Data

US 2006/0103315 A1 May 18, 2006

(30) Foreign Application Priority Data

Jul. 29, 2002 (EP) ..... 02078111

(51) Int. Cl.
*H01J 1/62* (2006.01)
*H01J 63/04* (2006.01)

(52) U.S. Cl. ..... 313/635; 313/634; 313/489; 313/493

(58) Field of Classification Search ..... 313/635
See application file for complete search history.

(56) References Cited

U.S. PATENT DOCUMENTS

| | | | | |
|---|---|---|---|---|
| 4,544,997 | A | 10/1985 | Seuter et al. | |
| 5,801,483 | A | 9/1998 | Sakakiabra et al. | |
| 5,869,927 | A * | 2/1999 | Matsuo et al. | 313/485 |
| 2001/0026122 | A1 * | 10/2001 | Snijkers-Hendrickx et al. | 313/493 |

FOREIGN PATENT DOCUMENTS

| | | | |
|---|---|---|---|
| DE | 19603300 | A1 | 7/1997 |
| DE | 19603300 | C2 | 7/1997 |
| WO | WO0156350 | A1 | 8/2001 |
| WO | WO0250871 | A1 | 6/2002 |

* cited by examiner

*Primary Examiner*—Nimeshkumar D. Patel
*Assistant Examiner*—Anthony T Perry

(57) ABSTRACT

A low-pressure mercury vapor discharge lamp (1) has a discharge vessel (3) enclosing, in a gastight manner, a discharge space provided with a filling of mercury and a rare gas. The discharge vessel (3) comprises means for maintaining an electric discharge in the discharge space. A portion of the surface (15) of the discharge vessel (3) facing the discharge space is provided with a protective layer (16) comprising yttrium oxide or aluminum oxide and further comprises a borate and/or a phosphate of an alkaline earth metal and/or of scandium, yttrium, or a further rare earth metal. Preferably, the alkaline earth metal is calcium, strontium, and/or barium. Preferably, the further rare earth metal is lanthanum, cerium, and/or gadolinium. The lamp according to the invention has a comparatively low mercury consumption.

14 Claims, 1 Drawing Sheet

LOW-PRESSURE MERCURY VAPOR DISCHARGE LAMP

Figure 1:
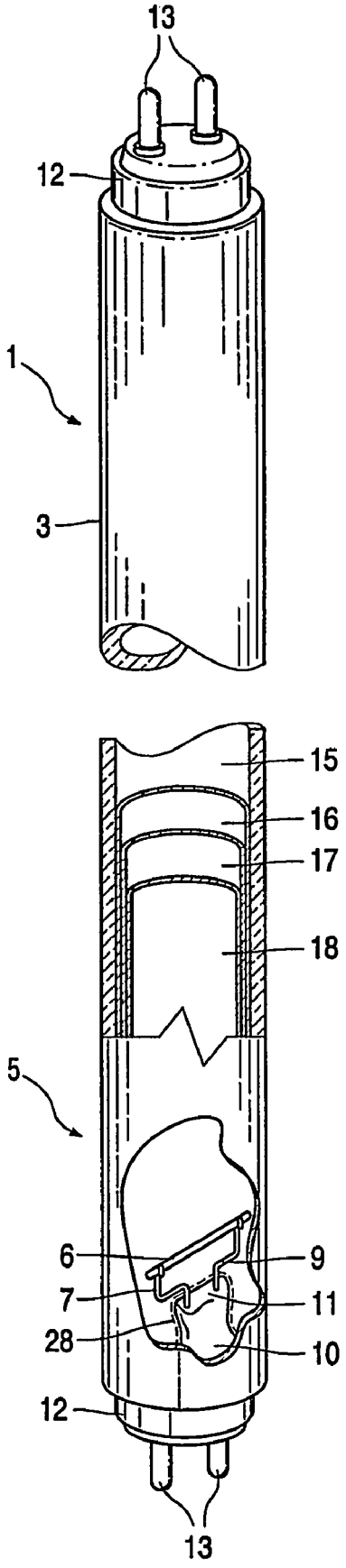

The invention relates to a low-pressure mercury vapor discharge lamp comprising a discharge vessel, the discharge vessel enclosing, in a gastight manner, a discharge space provided with a filling of mercury and a rare gas, the discharge vessel comprising means for maintaining an electric discharge in the discharge space, a portion of the surface of the discharge vessel facing the discharge space being provided with a protective layer.

In mercury vapor discharge lamps, mercury constitutes the primary component for the (efficient) generation of ultraviolet (UV) light. A luminescent layer comprising a luminescent material (for example a fluorescent powder) may be present on an inner wall of the discharge vessel to convert UV to other wavelengths, for example to UV-B and UV-A for tanning purposes (sun panel lamps) or to visible radiation for general illumination purposes. Such discharge lamps are therefore also referred to as fluorescent lamps. Alternatively, the ultraviolet light generated may be used for obtaining germicidal properties (UV-C). The discharge vessel of a low-pressure mercury vapor discharge lamp is usually circular and comprises both elongate and compact embodiments. Generally, the tubular discharge vessel of a compact fluorescent lamp comprises a collection of relatively short straight parts having a relatively small diameter, which straight parts are connected together by means of bridge parts or via bent parts. Compact fluorescent lamps are usually provided with an (integrated) lamp cap. Normally, the means for maintaining a discharge in the discharge space are electrodes arranged in the discharge space. In an alternative embodiment, the low-pressure mercury vapor discharge lamp is a so-called electrodeless low-pressure mercury vapor discharge lamp.

It is known that measures are taken in low-pressure mercury vapor discharge lamps to inhibit blackening of parts of the inner wall of the discharge vessel, which parts are in contact with the discharge which, during operation of the discharge lamp, is present in the discharge space. Such a blackening, which is caused by an interaction of mercury and glass, is undesirable and does not only give rise to a lower light output but also gives the lamp an unaesthetic appearance, particularly because the blackening occurs irregularly, for example in the form of dark stains or dots. The use of a protective layer as mentioned in the opening paragraph reduces the degree of blackening and discoloration of the inner wall of the discharge vessel.

A low-pressure mercury vapor discharge lamp of the type described in the opening paragraph is known from U.S. Pat. No. 4,544,997. In the known discharge lamp, yttrium oxide is provided as a protective layer on the inner wall of the discharge vessel.

A drawback of the use of the known low-pressure mercury vapor discharge lamp is that the consumption of mercury is still relatively high. As a result, a relatively large amount of mercury is necessary for the known lamp so as to realize a sufficiently long lifetime. In the case of injudicious processing after the end of the lifetime, this is detrimental to the environment.

It is an object of the invention to provide a low-pressure mercury vapor discharge lamp of the type described in the opening paragraph that consumes a relatively small amount of mercury. To this end, the low-pressure mercury vapor discharge lamp according to the invention is characterized in that the protective layer comprises aluminum oxide or yttrium oxide and further comprises a borate and/or a phosphate of an alkaline earth metal and/or of scandium, yttrium, or a further rare earth metal.

Protective layers comprising a combination of a layer comprising yttrium oxide or aluminum oxide and the metal borates and/or phosphates in accordance with the inventive measure are found to be very well resistant to the effect of the mercury-rare gas atmosphere which, in operation, prevails in the discharge vessel of a low-pressure mercury vapor discharge lamp. It has surprisingly been found that the mercury consumption of low-pressure mercury vapor discharge lamps provided with a protective layer according to the invention is considerably lower than with the known protective layer of the known low-pressure mercury vapor discharge lamps. By way of example, low-pressure mercury vapor discharge lamps provided with a protective layer according to the invention were compared with known low-pressure mercury vapor discharge lamps provided with a known protective layer. After several thousand operating hours, substantially half the amount of mercury, or even less, was found in protective layers according to the invention as compared with the known protective layers.

Not wishing to be held to any particular theory, the inventors believe that the addition of borates and/or phosphates of alkaline earth metals and/or of scandium, yttrium, or further rare earth metals reduces the number of so-called active sites in the known protective layer of yttrium oxide or aluminum oxide. As a consequence, the diffusion of Na-ions from the glass is reduced, and the affinity (chemical attraction) between mercury and the protective layer according to the invention is reduced.

The protective layers in the low-pressure mercury vapor discharge lamp according to the invention further satisfy the requirements of light and radiation transmissivity and can be easily provided as very thin, closed, and homogeneous protective layers on an inner wall of a discharge vessel of a low-pressure mercury vapor discharge lamp. This is effected, for example, by rinsing the discharge vessel with a solution of a mixture of suitable metal-organic compounds (for example acetonates or acetates, for example scandium acetate, yttrium acetate, lanthanum acetate, or gadolinium acetate mixed with calcium acetate, strontium acetate, or barium acetate) or of boric acid or of phosphoric acid diluted in water, whereupon the desired protective layer is obtained after drying and sintering.

An additional advantage of the use of protective layers according to the invention in low-pressure mercury vapor discharge lamps is that such protective layers have a relatively high reflectivity in the wavelength range around 254 nm (mercury in the discharge vessel, generates, inter alia, resonance radiation at a wavelength of 254 nm). Given the refractive index of the protective layer, which is relatively high with respect to the refractive index of the inner wall of the discharge vessel, its layer thickness is preferably chosen such that the reflectivity at said wavelength is maximal. The use of such protective layers increases the initial light output of low-pressure mercury vapor discharge lamps.

In a preferred embodiment of the low-pressure mercury vapor discharge lamp according to the invention, the protective layer comprises a borate and/or a phosphate of calcium, strontium, and/or barium. Such a protective layer has a relatively high coefficient of transmission for visible light. Moreover, low-pressure mercury vapor discharge lamps with a protective layer comprising yttrium oxide or aluminum oxide and additionally comprising calcium borate, strontium borate, or barium borate, or calcium phosphate, strontium phosphate, or barium phosphate have a good lumen maintenance.

In a further preferred embodiment of the low-pressure mercury vapor discharge lamp according to the invention, the protective layer comprises a borate and/or a phosphate of lanthanum, cerium, and/or gadolinium. Such a protective layer has a relatively high coefficient of transmission for ultraviolet radiation and visible light. It has further been found that a protective layer comprising lanthanum borate or gadolinium borate or comprising cerium phosphate or gadolinium phosphate has a good adhesion to the inner wall of the discharge vessel. Moreover, the protective layer can be provided in a relatively simple manner (for example with lanthanum acetate, cerium acetate, or gadolinium acetate mixed with boric acid or dilute phosphoric acid), which has a cost-saving effect, notably in a mass manufacturing process for low-pressure mercury vapor discharge lamps.

An additional advantage of the use in low-pressure mercury vapor discharge lamps of a protective layer comprising yttrium oxide or aluminum oxide and additionally a borate and/or a phosphate of scandium, yttrium, lanthanum, cerium, and/or gadolinium is that such protective layers have a relatively high reflectivity in the wavelength range around 254 nm. By using said high-refractive protective layers and by optimizing the layer thickness of such protective layers, it is possible to obtain a low-pressure mercury vapor discharge lamp having an increased initial light output. Such protective layers may be used to particular advantage in, for example, low-pressure mercury vapor discharge lamps for germicidal purposes.

A preferred embodiment of the low-pressure mercury vapor discharge lamp according to the invention is characterized in that the aluminum oxide comprises particles with an effective particle size $d_p$ not exceeding 3 μm, preferably in a range of $0.1 \leqq d_p \leqq 0.8$ μm. In practice, the larger-sized aluminum oxide particles are derived from Baikowsky CR6 aluminum oxide powder and the smaller aluminum oxide particles are derived from Alon-C manufactured by Degussa.

In practical embodiments of the low-pressure mercury vapor discharge lamp, the protective layer comprises an alkaline earth borate, and the layer thickness is in a range from 0.1 to 50 μm. The use of an aluminum oxide protective layer in combination with an alkaline earth borate and with a thickness in the range given above is found to give a good resistance to the action of the mercury-rare gas atmosphere in the discharge vessel. The inventors have had the insight that by using a suspension of "nano-particles" of alkaline earth borates, in particular calcium, strontium, and/or barium borate, they can make a protective layer with a thickness which can be significantly greater than that of the protective layer made from a solution of the salts in the known discharge lamp. The expression "nano-particles" in the description of the present invention denotes particles with a particle size in a range from 0.1 to 1 μm. The softening point of the calcium, strontium, and/or barium borate particulate material is low enough for the particles to fuse together during the glass shaping (bending) process. In addition, a dense protective layer is obtained that because of its great thickness, has not completely reacted with the underlying wall of the discharge vessel in the bends and in the seal. It was found in experiments that a protective layer made from nano-particles of calcium, strontium, and/or barium borate showed a relatively high point of zero charge and a relatively low mercury consumption. An additional advantage of producing the protective layer from nano-particles of alkaline earth borates is that the size of the particles of alkaline earth borates is comparable to the wavelength of the UV light. This makes it possible to employ the protective layer also as a reflector for UV light (the size of the particles is in a range from approximately 0.3 μm to approximately 0.6 μm). Preferably, the protective layer comprises $SrB_4O_7$. Preferably, nano-particles of $SrB_4O_7$ with a particle size in a range from approximately 0.1 to approximately 1 μm are used to manufacture the protective layer according to the invention.

Preferably, the thickness of the protective layer is in a range from 1 to 20 μm. Making the protective layer thinner than approximately 10 μm could give rise to a possible complete reaction of the particulate calcium, strontium, and/or barium borate with the wall, in particular during the glass shaping (bending) process of discharge vessels under factory conditions. The risk is higher in a production environment where the conditions cannot always be met as precisely as in laboratory experiments. It is observed that the particles in the protective layer in the straight parts of the discharge vessel of compact fluorescent lamps do not reach a high enough temperature to melt, leading to diffuse scattering of light in the protective layer. In the arc-shaped parts of the discharge vessel of compact fluorescent lamps, the particles in the protective layer reach a high enough temperature to melt, leading to a transparent protective layer.

A preferred embodiment of the low-pressure mercury vapor discharge lamp according to the invention is characterized in that the discharge vessel comprises at least one stem, said stem being provided with the protective layer. Coating the stems of a discharge vessel with the protective layer provides additional protection from sodium diffusion from the stem glass. In this embodiment the means for maintaining the discharge are electrodes which are supported by conducting lead wires extending through a glass pinch provided on the stem.

A preferred embodiment of the low-pressure mercury vapor discharge lamp according to the invention is characterized in that the discharge vessel is made from a glass comprising silicon dioxide and sodium oxide, with the glass composition comprising the following essential constituents, given in percentages by weight (wt. %): 60-80% $SiO_2$ and 10-20% $Na_2O$. The application of a protective layer according to the invention in combination with the sodium-rich glass in accordance with the invention causes blackening to be substantially reduced in the discharge vessel. The invention is in particular embodied in a combination of a discharge vessel with a coating comprising the borate and/or phosphate as described above and the sodium-rich glass.

Sodium-rich glasses are comparatively inexpensive. In the known discharge lamp, use is made of a so-called mixed alkali glass having a comparatively low $SiO_2$ content (approximately 67% as against approximately 72% for the sodium-rich glass) and comprising, inter alia, approximately 8% $Na_2O$ and 5% $K_2O$. The cost price of such a glass is comparatively high. A comparison between the composition of the known glass and the sodium-rich glass shows the alkali content to be different. The sodium-rich glass has a comparatively low potassium content, whereas the known glass is a so-called mixed alkali glass having an approximately equal molar ratio of $Na_2O$ and $K_2O$. An advantage is that the mobility of the alkali ions in the sodium-rich glass is comparatively high compared with the mobility in the mixed alkali glass. The so-called run-up time for low-pressure mercury vapor discharge lamps made from sodium-rich glass is approximately the same as for discharge vessels made from the known mixed alkali glass.

The glass composition preferably comprises the following constituents: 70-75% $SiO_2$, 15-18% $Na_2O$, and 0.25-2% $K_2O$. The composition of such a sodium-rich glass is similar to that of ordinary window glass and it is comparatively cheap with respect to the glass used in the known discharge lamp. The cost price of the raw materials for the sodium-rich glass as used in the discharge lamp in accordance with the invention is only approximately 50% of the cost price of the raw materials for the mixed alkali glass as used in the known discharge lamp. Moreover, the conductivity of said sodium-rich glass is comparatively low; at 250° C. the conductance is approximately log ρ=6.3 whereas the corresponding value of the mixed alkali glass is approximately log ρ=8.9.

A further preferred embodiment of the low-pressure mercury vapor discharge lamp according to the invention is characterized in that a side of the protective layer facing the discharge space is provided with a luminescent layer of a luminescent material. An advantage of the use of a protective layer according to the invention in low-pressure mercury vapor discharge lamps is that the luminescent layer comprising a luminescent material (for example a fluorescence powder) has at least substantially the same adhesion to such a protective layer as to a protective layer of the known low-pressure mercury vapor discharge lamp. In an alternative embodiment, the fluorescent layer is provided in between the protective layer according to the invention and the wall of the discharge vessel. In a particularly preferred embodiment of the low-pressure mercury vapor discharge lamp, a protective layer is provided between the inner wall of the discharge vessel and the luminescent layer as well as on top of the luminescent layer, said additional protective layer facing the discharge space.

The measure according to the invention is suitable for compact fluorescent lamps having arc-shaped lamp parts, wherein the discharge vessel is additionally surrounded by a light-transmitting envelope. The temperature of the discharge vessel of such "covered" compact fluorescent lamps is comparatively high because the heat dissipation to the environment is reduced by the presence of the outer envelope. This unfavorable temperature balance adversely affects the lumen maintenance of the known discharge lamp owing to an increased level of blackening. It was surprisingly found in experiments that the lumen maintenance of a compact fluorescent lamp provided with a low-pressure mercury vapor discharge lamp according to the invention, the discharge vessel of which is surrounded by an envelope, has 90% lumen maintenance after 12,000 burning hours, whereas the lumen maintenance of an identical compact fluorescent lamp provided with the known low-pressure mercury vapor discharge lamp, the discharge vessel of which is surrounded by an envelope, is less than 80% after 12,000 burning hours and fluctuates (depending on the amount of Hg consumed). The depletion of mercury from the amalgam can be so high that the amalgam does no longer give the optimum mercury pressure. In addition, the light output drops significantly.

These and other aspects of the invention are apparent from and will be elucidated with reference to the embodiments described hereinafter.

In the drawings:

FIG. 1 is a side elevation, partly broken away, of an embodiment of a low-pressure mercury vapor discharge lamp according to the invention.

The FIGURE is purely diagrammatic and not drawn to scale. Particularly for clarity, some dimensions are exaggerated strongly. Similar components in the FIGURE is denoted by the same reference numerals as much as possible.

FIG. 1 is a side elevation, partly broken away, of an embodiment of a low-pressure mercury discharge lamp with an elongate glass discharge vessel 3. The radiation-transmitting discharge lamp comprises an electrode 5 at each end (only one electrode is shown in FIG. 1), which electrode is formed by a tungsten incandescent coil 6 supported by conducting lead wires 7, 9 which extend through a glass pinch 11 which is provided on a glass stem 10. The incandescent coil 6 is provided with an emitter material such as oxides of barium, calcium, and/or strontium for reducing the work function of the electrode. The stem 10 hermetically seals off the discharge vessel 3. The lead wires 7, 9 are connected to pin-type contacts 13 in the respective end caps 12 which are provided at either end of the discharge lamp. The discharge vessel 3 is filled with a rare gas mixture comprising one or several of the gases xenon, krypton, argon, and neon under a certain filling pressure. The discharge vessel 3 is further provided with a sufficient quantity of mercury.

The glass of the discharge vessel of the low-pressure mercury-vapor discharge lamp preferably has a composition comprising silicon dioxide and sodium oxide as important constituents. In the example shown in FIG. 1, the discharge vessel 3 is made from so-called sodium-rich glass. Particularly preferred is a glass of the following composition: 70-74% SiO2, 16-18% $Na_2O$, 0.5-1.3% $K_2O$, 4-6% CaO, 2.5-3.5% MgO, 1-2% $Al_2O_3$, 0-0.6% $Sb_2O_3$, 0-0.15% $Fe_2O_3$, and 0-0.05% MnO by weight.

A portion 15 of the surface of the discharge vessel 3 facing the discharge space is provided with a protective layer 16 comprising yttrium oxide or aluminum oxide and a borate and/or a phosphate of an alkaline earth metal and/or of scandium, yttrium, or a further rare earth metal. The protective layer 16 is provided for reducing the absorption of mercury by the glass of the discharge vessel 3. An advantage of using a protective layer comprising a borate and/or a phosphate of scandium, yttrium, lanthanum, cerium, and/or gadolinium is that the mercury consumption of low-pressure mercury vapor discharge lamps provided with such a protective layer is considerably lower than with protective layers in the known low-pressure mercury vapor discharge lamps. Preferably, the stem 10 in the discharge vessel is also provided with a protective layer 28.

If the protective layer comprises aluminum oxide, the particles have an effective particle size $d_p$ not exceeding 3 μm, preferably in a range of $0.1 \leqq d_p \leqq 0.8$ μm. In practice, the larger-sized particles are obtained from Baikowsky CR6 aluminum oxide powder. A median diameter of 0.47 μm was measured with a SHIMADZU SA-CP3 particle size gauge. For this purpose, a suspension containing 10% CR6 by weight was charge-stabilized in an acetic acid solution of $10^{-2}$ molarity in that it was vibrated ultrasonically for five minutes in a Branson 1200 type ultrasonic cleaner. The specific surface of CR6 is approximately 6 $m^2/g$. The smaller particles are derived from Alon-C manufactured by Degussa with a median diameter of approximately 0.013 μm and a specific surface of approximately 100 $m^2/g$.

In addition, a luminescent layer 17, preferably a halophosphate layer, is provided on top of said protective layer 16. In another embodiment, the luminescent material comprises a mixture of green-luminescing, terbium-activated cerium-magnesium aluminate, blue-luminescing barium-magnesium aluminate activated by bivalent europium, and red-luminescing yttrium oxide activated by trivalent europium. Preferably, the luminescent layer 17 is provided with an additional protective layer 18, said additional protective layer 18 facing the discharge space.

In an embodiment of the low-pressure mercury vapor discharge lamp, various concentrations of a strontium acetate solution, an yttrium acetate solution, and boric acid are added to solutions comprising various concentrations of $Al_2O_3$ (aluminum oxide) to manufacture the protective layer 16, 18, 28 according to the invention. In an alternative embodiment, a barium acetate solution is added instead of a strontium acetate solution. Table I shows the results of lumen maintenance tests for typical T5 lamps.

TABLE I

Lumen maintenance of discharge lamps (T5 28 W) with known protective layers and with protective layers according to the invention.

| | $Y(Ac)_3$ | $Al_2O_3$ % by weight | $Sr(Ac)_2$ (mole) | $H_3BO_3$ (mole) | Lumens/ Watt 100 hrs | 100 hrs (%) | 2000 hrs (%) |
|---|---|---|---|---|---|---|---|
| 1 | — | — | — | — | 108 | 100 | 91.6 |
| 2 | 5 | 3 | 0.048 | 0.19 | 104 | 100 | >96 |
| 3 | — | 3.75 | 0.028 | 0.11 | 102 | 100 | 94.2 |

Table I shows that the lumen maintenance of low-pressure mercury vapor discharge lamps provided with a protective layer according to the invention is improved with respect to the known discharge lamp provided with the known aluminum oxide protective layer. Comparable tests, in which $Ba(Ac)_2$ instead of $Sr(Ac)_2$ was used as a precursor for the protective layer, show that the maintenance of these discharge lamps is comparable to that of the known discharge lamp, but the discharge lamps having a Ba addition according to the invention have an improved adhesion of the luminescent layer to the protective layer.

By way of example, the mercury content (in μg Hg) of the known discharge lamp with the known aluminum oxide protective layer was compared with the mercury content of discharge lamps with a protective layer according to the invention. The measurements were (destructively) carried out on six lamps after several thousand operating hours. Values found for the mercury consumption were averaged. After several thousand operating hours, approximately half the mercury content was found in protective layers according to the invention as compared with the known protective layers. For the T5 28 W as mentioned above, the typical mercury consumption is in the order or 100 μg Hg after 1000 hours of life. As a comparison, a known TLD (4 feet) has a mercury consumption of 500-1000 μg Hg after 1000 hours of life. It is to be noted that the color point of the low-pressure mercury vapor discharge lamp provided with protective layers according to the invention satisfies the customary requirements ($x \approx 0.31$, $y \approx 0.32$). Comparable results are obtained if yttrium oxide instead of aluminum oxide is used as basis for the protective layer.

It will be evident that many variations within the scope of the invention may be conceived by those skilled in the art. The low-pressure mercury vapor discharge lamp with an aluminum oxide protective layer may also be used for reprographic purposes. In that case, the aluminum oxide protective layer functions as a reflective protective layer.

The scope of the invention is not limited to the embodiments. The invention resides in each new characteristic feature and each combination of novel characteristic features. Any reference signs do not limit the scope of the claims. The word "comprising" does not exclude the presence of other elements or steps than those listed in a claim. Use of the word "a" or "an" preceding an element does not exclude the presence of a plurality of such elements.

The invention claimed is:

1. A low-pressure mercury vapor discharge lamp comprising a discharge vessel, the discharge vessel enclosing, in a gastight manner, a discharge space provided with a filling of mercury and a rare gas, the discharge vessel comprising a luminescent layer and means for maintaining an electric discharge in the discharge space, a portion of an inner surface of the discharge vessel facing the discharge space being provided with a protective layer adjacent said luminescent layer, wherein protective layer comprises a phosphate of scandium and wherein a thickness of the protective layer is in a range from 1 to 20 μm.

2. The low-pressure mercury vapor discharge lamp as claimed in claim 1, wherein the protective layer further comprises a phosphate of calcium, and/or strontium.

3. The low-pressure mercury vapor discharge lamp as claimed in claim 1, wherein the protective layer further comprises a borate and/or a phosphate of gadolinium.

4. The low-pressure mercury vapor discharge lamp as claimed in claim 1, wherein the protective layer further comprises aluminum oxide comprising particles with an effective particle size $d_p$ not exceeding 3 μm.

5. The low-pressure mercury vapor discharge lamp as claimed in claim 1, wherein the protective layer further comprises an alkaline earth borate.

6. The low-pressure mercury vapor discharge lamp as claimed in claim 5, wherein the protective layer comprises $SrB_4O_7$.

7. The low-pressure mercury vapor discharge lamp as claimed in claim 1, wherein the discharge vessel comprises at least one stem, said stem being provided with the protective layer.

8. The low-pressure mercury vapor discharge lamp as claimed in claim 1, the discharge vessel is made from a glass comprising silicon dioxide and sodium oxide, with the glass composition comprising the following essential constituents, given in percentages by weight:

60-80% $SiO_2$, 10-20% $Na_2O$.

9. The low-pressure mercury vapor discharge lamp as claimed in claim 8, wherein the glass composition comprises the following constituents:

70-75% $SiO_2$, 15-18% $Na_2O$, 0.25-2% $K_2O$ by weight.

10. The low-pressure mercury vapor discharge lamp as claimed in claim 1, wherein the luminescent material comprises a mixture of green-luminescing, terbium-activated cerium-magnesium aluminate, blue-luminescing barium-magnesium aluminate activated by bivalent europium, and red-luminescing yttrium oxide activated by trivalent europium.

11. The low-pressure mercury vapor discharge lamp as claimed in claim 1, wherein the protective layer further comprises aluminum oxide comprising particles with an effective particle size $d_p$ in the range of $0.1 \leqq d_p \leqq 0.8$ μm.

12. The low-pressure mercury vapor discharge lamp of claim 1, wherein the protective layer further comprises aluminum oxide or yttrium oxide and a borate an alkaline earth metal and/or of scandium, yttrium, or a further rare earth metal.

13. The low-pressure mercury vapor discharge lamp of claim 1, wherein the protective layer further comprises a phosphate of yttrium, or a further rare earth metal.

14. The low-pressure mercury vapor discharge lamp of claim 1, wherein an inner side of the protective layer facing the discharge space is provided with said luminescent layer, and an inner side of said luminescent layer facing the discharge space is provided with an additional protective layer.

* * * * *